US006590989B2

(12) United States Patent
Chen

(10) Patent No.: US 6,590,989 B2
(45) Date of Patent: Jul. 8, 2003

(54) DESKTOP MICROPHONE BASE WITH A SHOCK ABSORBING MEMBER

(75) Inventor: Chin-Chun Chen, Taipei (TW)

(73) Assignee: Yoga Electronics Co., Ltd., Taipei (TW)

( * ) Notice: Subject to any disclaimer, the term of this patent is extended or adjusted under 35 U.S.C. 154(b) by 315 days.

(21) Appl. No.: 09/739,377

(22) Filed: Dec. 19, 2000

(65) Prior Publication Data

US 2002/0048384 A1 Apr. 25, 2002

(30) Foreign Application Priority Data

Oct. 20, 2000 (TW) ..... 089218220 U

(51) Int. Cl.[7] ..... H04R 9/08
(52) U.S. Cl. ..... 381/363; 248/121; 248/188.9
(58) Field of Search ..... 381/355, 361, 381/362, 363, 366, 368, FOR 147, FOR 148; 248/559, 566, 638

(56) References Cited

U.S. PATENT DOCUMENTS 3,573,401 A * 4/1971 Lininger ..... 381/363
4,853,965 A * 8/1989 Blonski ..... 381/363
4,955,578 A * 9/1990 Fidi ..... 381/363
5,988,585 A * 11/1999 Eaton ..... 381/91

* cited by examiner

*Primary Examiner*—Sinh Tran
*Assistant Examiner*—Brian Ensey
(74) *Attorney, Agent, or Firm*—Morgan, Lewis & Bockius LLP

(57) ABSTRACT

A microphone base includes a rigid base body, a rigid microphone connector, a circuit board unit and a shock absorbing member. The base body includes an upper housing which is formed with an opening, and a lower housing which is disposed under and which is connected removably to the upper housing. The upper and lower housings cooperatively define a chamber therebetween, which is in communication with the opening in the upper housing. The microphone connector is disposed within the opening in the upper housing of the base body, and is adapted to be in electrical connection with a microphone. The circuit board unit is disposed within the chamber in the base body, and is in electrical connection with the connector. The shock absorbing member is made of a resilient material for connecting the connector fixedly to the base body while preventing direct contact between the connector and the base body.

1 Claim, 3 Drawing Sheets

DESKTOP MICROPHONE BASE WITH A SHOCK ABSORBING MEMBER

BACKGROUND OF THE INVENTION

1. Field of the Invention

This invention relates to a desktop microphone base, more particularly to a desktop microphone base with a shock absorbing member.

2. Description of the Related Art

Referring to FIG. 1, a microphone 12 is mounted on a conventional desktop microphone base which includes a rigid base body 10, a circuit board unit 13 disposed within the base body 10, and a rigid microphone connector 11 which is fixed to an upper housing of the base body 10 and which is electrically coupled to the circuit board unit 13. An on/off switch 14 is provided on the upper housing of the base body 10, and is electrically connected to the circuit board unit 13.

A drawback that results from the use of the conventional desktop microphone base is as follows:

The microphone is usually used in an auditorium, where there are plenty of attendants. In case the speaker moves the mouthpiece 120 of the microphone 12 relative to the base body 10 in order to align the mouthpiece 120 with the speaker's mouth, noise is generated due to the rigid connection between the microphone connector 11 and the microphone 12.

SUMMARY OF THE INVENTION

Therefore, the object of this invention is to provide a desktop microphone base which is adapted for mounting a microphone thereon and which is provided with a shock absorbing member so as to absorb vibration due to shifting position of the microphone.

Accordingly, a desktop microphone base of the present invention includes a rigid base body, a rigid microphone connector, a circuit board unit and a shock absorbing member. The rigid base body includes an upper housing which is formed with an opening, and a lower housing which is disposed under and which is connected removably to the upper housing. The upper and lower housings cooperatively define a chamber therebetween, which is in communication with the opening in the upper housing. The microphone connector is disposed within the opening in the upper housing of the base body, and is adapted to be in electrical connection with a microphone. The circuit board unit is disposed within the chamber in the base body and is in electrical connection with the connector. The shock absorbing member is made of a resilient material for connecting the connector fixedly to the base body while preventing direct contact between the connector and the base body.

In case the connector moves due to movement of the connected microphone, the resulting vibration is absorbed by the shock absorbing member and is prevented from reaching the base body.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
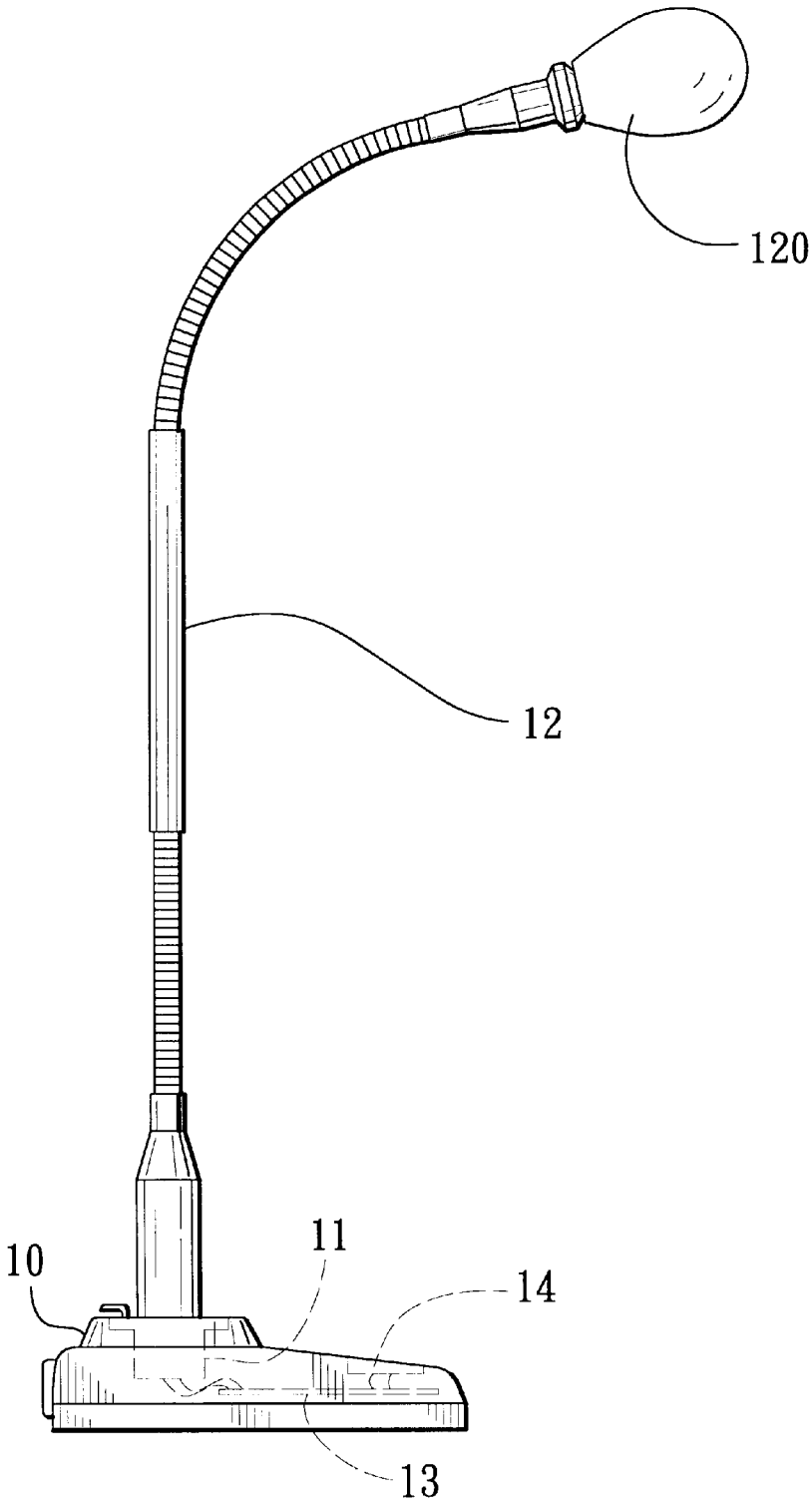
F I G. 1 PRIOR ART
FIG. 1 is a schematic view of a conventional desktop microphone base with a microphone mounted thereon.
Figure 2:
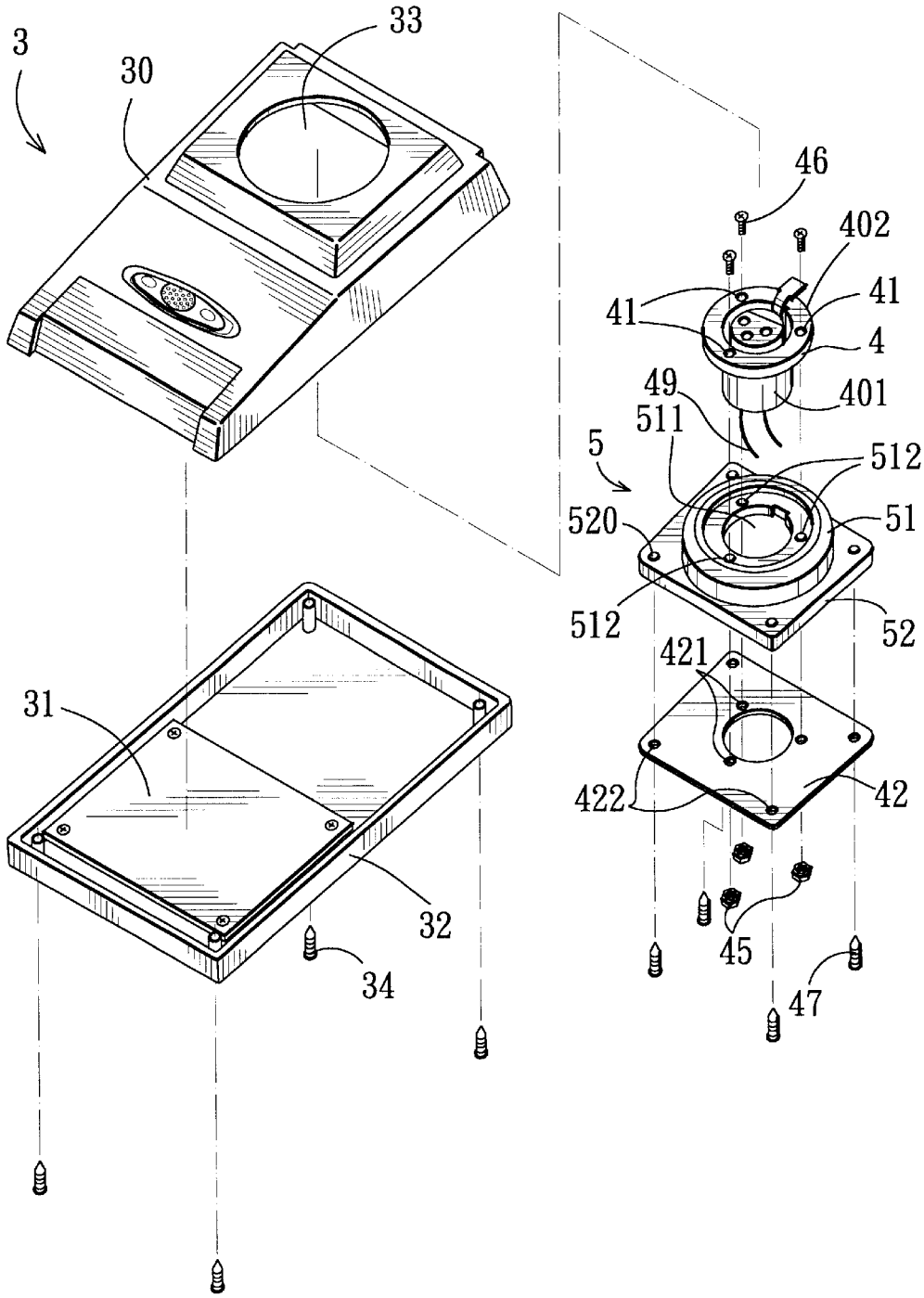
FIG. 2 is an exploded perspective view of the preferred embodiment of a desktop microphone base of the present invention.
Figure 3:
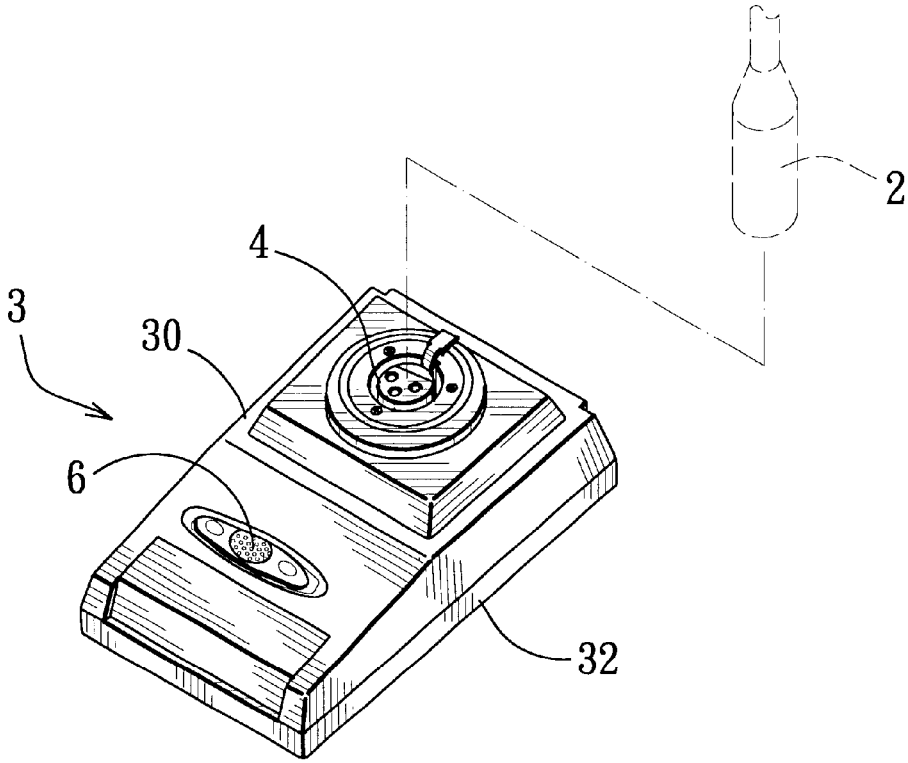
FIG. 3 is an assembled perspective view of the preferred embodiment.
Figure 4:
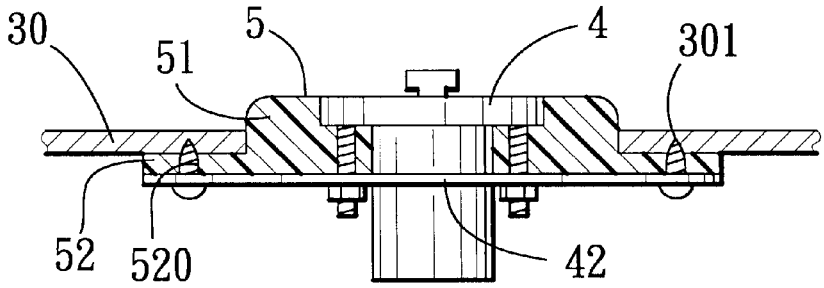
FIG. 4 is a fragmentary sectional view of the preferred embodiment.

Referring to FIGS. 2 to 4, the preferred embodiment of a desktop microphone base according to the present invention is shown to include a rigid base body 3, a rigid microphone connector 4, an integrated circuit board unit 31 and a shock absorbing member 5.

As illustrated, the base body 3, preferably made of a rigid material like metal, includes an upper housing 30 which is formed with an opening 33, and a lower housing 32 which is disposed under and which is connected removably to the upper housing 30. The upper and lower housings 30,32 cooperatively define a chamber therebetween, which is in communication with the opening 33 in the upper housing 30.

The microphone connector 4 is disposed within the opening 33 in the upper housing 30 of the base body 3, and is adapted to be in electrical connection with a microphone 2 (shown by perforated lines in FIG. 3).

The circuit board unit 31 is disposed within the chamber in the base body 3, and is in electrical connection with the connector 4.

The shock absorbing member 5 is made of a resilient material for connecting the connector 4 fixedly to the base body 3 while preventing direct contact between the connector 4 and the base body 3. Preferably, the shock absorbing member 5 is a unitary member, and has a vertical, hollow, upper cylinder 51 that extends through the opening 33 in the upper housing 30 of the base body 3 and that has an axial central hole 511 formed therethrough, and a horizontal lower flange 52 that extends radially and outwardly from a lower end of the upper cylinder 51 and that is connected fixedly to the upper housing 30 of the base body 3. The lower flange 52 is disposed within the chamber in the base body 3, and is sized so as to prevent upward removal of the shock absorbing member 5 from the base body 3 via the opening 33.

The upper housing 30 of the base body 3 has a bottom surface that is formed with a plurality of threaded holes 301. The upper cylinder 51 of the shock absorbing member 5 is formed with three holes 512 therethrough. The lower flange 52 of the shock absorbing member 5 is formed four holes 520 therethrough at four corners thereof. The microphone connector 4 has a vertical lower cylinder 401 that extends through the central hole 511 in the upper cylinder 51 of the shock absorbing member 5, and a horizontal upper flange 402 that extends radially and outwardly from an upper end of the lower cylinder 401. The upper flange 402 of the microphone connector 4 is formed with three holes 41 therethrough.

When assembling the microphone base of the present invention, the circuit board unit 31 is installed within the upper housing 30 adjacent to the opening 33. The shock absorbing member 5 is inserted from a bottom surface of the upper housing 30 in such a manner that the upper cylinder 51 is exposed to the base body 3 via the opening 33 while the lower flange 52 abuts against the lower surface of the upper housing 30. The microphone connector 4 is mounted in the upper cylinder 51 of the shock absorbing member 5 such that the upper flange 402 rests on an upper end of the upper cylinder 51 of the shock absorbing member 5. A horizontal rigid ring plate 42 is disposed under the shock absorbing member 3, and has a central hole that permits extension of the lower cylinder 401 of the connector 4 therethrough, and a top surface that abuts against a bottom surface of the lower flange 52 of the shock absorbing member 5. Three nuts 45 are disposed under the ring plate 42. Three headed bolts 46 are inserted from an upper end of the connector 4, and extend respectively through the holes 41 in the upper flange 402 of the connector 4, the holes 512 in the upper cylinder 51 of the shock absorbing member 5, and the first holes 421 in the rigid ring plate 42 to engage the nuts 45. Four headed tap screws 47 are inserted from a lower surface of the rigid plate 42, and extend respectively through the second holes 422 in the ring rigid ring plate 42 and the holes 520 in the lower flange 52 of the shock absorbing member 5 to engage the threaded holes 301 in the upper housing 30 of the base body 3, thereby securing the assembly of the rigid ring plate 42 and the shock absorbing member 5 on the upper housing 30. Two electrical cables 49 of the microphone connector 4 extend through the shock absorbing member 5 and the rigid ring plate 42 to interconnect the circuit board unit 31 and the connector 4 for establishing the electrical connection between the circuit board unit 31 and the connector 4. Finally, the lower housing 32 is fastened to the upper housing 30 by means of fastener screws 34. The connector 4 is provided with an annular recess within which a lower end of the microphone 2 can be mounted.

An on/off switch 6 is provided on the upper housing 30 for switch on and switch off of the microphone 2.

Because the vibration of the connector 4 which arises due to positions shifting of the microphone 2 can be totally absorbed by the shock absorbing member 5, the generation of noise can be accordingly reduced.

With this invention thus explained, it is apparent that numerous modifications and variations can be made without departing from the scope and spirit of this invention. It is therefore intended that this invention be limited only as indicated in the appended claims.

I claim:

1. A desktop microphone base comprising:

a rigid base body including an upper housing which is formed with an opening, and a lower housing which is disposed under and which is connected removably to said upper housing, said upper and lower housings cooperatively defining a chamber therebetween, which is in communication with said opening;

a rigid microphone connector disposed within said opening in said upper housing of said base body and adapted to be in electrical connection with a microphone;

a circuit board unit disposed within said chamber in said base body and in electrical connection with said connector; and a shock absorbing member made of a resilient material for connecting said connector fixedly to said base body while preventing direct contact between said connector and said base body, wherein said shock absorbing member is a unitary member, and has a vertical, hollow, upper cylinder that extends through said opening in said upper housing of said base body and that has an axial central hole formed therethrough, and a horizontal lower flange that extends radially and outwardly from a lower end of said upper cylinder and that is connected fixedly to said upper housing of said base body, said lower flange being disposed in said chamber in said base body and being sized so as to prevent upward removal of said shock absorbing member from said base body via said opening, and wherein said upper housing of said base body has a bottom surface that is formed with a plurality of threaded holes, said upper cylinder of said shock absorbing member being formed with a plurality of holes therethrough, said lower flange of said shock absorbing member being formed with a plurality of holes therethrough, said connector having a vertical lower cylinder that extends through said central hole in said upper cylinder of said shock absorbing member, and a horizontal upper flange that extends radially and outwardly from an upper end of said lower cylinder and that rests on an upper end of said upper cylinder of said shock absorbing member, said upper flange being formed with a plurality of holes therethrough, said microphone base further including:

a horizontal rigid ring plate sleeved on said lower cylinder of said connector and having a top surface that abuts against a bottom surface of said lower flange of said shock absorbing member, and a plurality of first and second holes that are formed through said ring plate;

a plurality of nuts disposed under said ring plate;

a plurality of headed bolts extending respectively through said holes in said upper flange of said connector, said holes in said upper cylinder of said shock absorbing member, and said first holes in said ring plate to engage said nuts;

a plurality of headed tap screws extending respectively through said second holes in said ring plate and said holes in said lower flange of said shock absorbing member to engage said threaded holes in said upper housing of said base body; and two electrical cables interconnecting said circuit board unit and said connector for establishing said electrical connection between said circuit board unit and said connector.

* * * * *